United States Patent [19]

Hoots et al.

[11] Patent Number: 4,756,881

[45] Date of Patent: Jul. 12, 1988

[54] COMPOSITION OF CORROSION INHIBITORS FOR COOLING WATER SYSTEMS USING CHEMICALLY MODIFIED ACRYLAMIDE OR METHACRYLAMIDE POLYMERS

[75] Inventors: John E. Hoots; Donald A. Johnson; Dodd W. Fong, all of Naperville, Ill.

[73] Assignee: Nalco Chemical Company, Naperville, Ill.

[21] Appl. No.: 861,762

[22] Filed: May 9, 1986

[51] Int. Cl.[4] ..... C23F 11/173; C23F 11/167; C02F 5/14

[52] U.S. Cl. ..... 422/13; 210/699; 252/179; 252/180; 252/181; 252/387; 252/389.2; 252/389.23; 524/123; 524/130; 524/132; 524/547; 525/329.8; 526/287; 422/15

[58] Field of Search ..... 252/179, 180, 181, 387, 252/389.23, 389.2; 525/329.8; 524/130, 123, 132, 547; 422/7, 13, 15; 526/287; 210/699

[56] References Cited

U.S. PATENT DOCUMENTS

| | | | |
|---|---|---|---|
| 3,332,904 | 7/1967 | Lacombe et al. . | |
| 3,692,673 | 9/1972 | Hoke . | |
| 3,880,765 | 4/1975 | Watson . | |
| 3,898,037 | 8/1975 | Lange et al. . | |
| 4,159,922 | 7/1979 | Cosper . | |
| 4,288,327 | 9/1981 | Godlewski et al. . | |
| 4,303,568 | 12/1981 | May et al. | 524/130 |
| 4,306,991 | 12/1981 | Hwa et al. | 252/180 |
| 4,324,684 | 4/1982 | Geiger et al. . | |
| 4,373,056 | 2/1983 | Besecke et al. | 526/287 |
| 4,384,979 | 5/1983 | Hansen | 422/16 |
| 4,406,811 | 9/1983 | Christensen et al. | 252/180 |
| 4,443,340 | 4/1984 | May et al. . | |
| 4,547,540 | 10/1985 | Yeoman | 524/130 |
| 4,575,425 | 3/1986 | Boffardi et al. | 252/180 |
| 4,576,722 | 3/1986 | Gaylor et al. | 252/180 |
| 4,581,145 | 4/1986 | Cuisia et al. | 252/180 |
| 4,600,524 | 7/1986 | Cuisia et al. | 252/180 |
| 4,604,431 | 8/1986 | Fong et al. | 525/351 |
| 4,640,793 | 2/1987 | Persinski et al. | 524/375 |
| 4,650,591 | 3/1987 | Boothe et al. | 422/15 |
| 4,659,482 | 4/1987 | Chen | 422/15 |

FOREIGN PATENT DOCUMENTS

| | | | |
|---|---|---|---|
| 2082600 | 3/1982 | United Kingdom | 526/287 |

OTHER PUBLICATIONS

Power, Jun. 1984, pp. S1–S23, Special Report "Cooling-Water Treatment for Control of Corrosion".

*Primary Examiner*—Herbert J. Lilling

*Attorney, Agent, or Firm*—John G. Premo; Anthony L. Cupoli; Donald G. Epple

[57] ABSTRACT

A composition and method for inhibiting corrosion in industrial cooling waters which contain hardness and have a pH of at least 8, which composition comprises a water-soluble organic phosphonate capable of inhibiting corrosion in an aqueous alkaliine environment and a hydrocarbon polymer containing an N-substituted acrylamide polymer with an amide structure as follows:

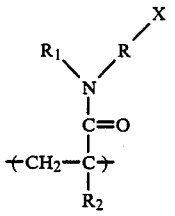

where $R_2$ is hydrogen or methyl, $R_1$ is a hydrogen or an alkyl and R is alkylene or phenylene, and X is sulfonate, (poly)hydroxyl, and combinations thereof.

9 Claims, No Drawings

COMPOSITION OF CORROSION INHIBITORS FOR COOLING WATER SYSTEMS USING CHEMICALLY MODIFIED ACRYLAMIDE OR METHACRYLAMIDE POLYMERS

FIELD OF INVENTION

A composition and method for inhibiting corrosion in industrial cooling waters which contain hardness and have a pH of at least 8, which composition comprises a water-soluble organic phosphonate capable of inhibiting corrosion in an aqueous alkaline environment and co- or terpolymers formed by post-polymerization derivatization.

The term "phosphonate" refers to organic materials containing one or more $—PO_3H_2$ groups and salts thereof. Phosphonates particularly useful in this invention include 1-hydroxy-1,1-ethane diphosphonic acid (HEDP), 2-phosphonobutane-1,2,4-tricarboxylic acid (PBTC), amino-tris-methylenephosphonic acid (AMP), and their salts. The concentrations and dosage levels and/or ranges of polymers, phosphonates and compositions are listed as actives on a weight basis unless otherwise specified.

The term "acryl" includes the term "methacryl".

INTRODUCTION

Corrosion occurs when metals are oxidized to their respective ions and/or insoluble salts. For example, corrosion of metallic iron can involve conversion to soluble iron in a +2 or +3 oxidation state or insoluble iron oxides and hydroxides. Also, corrosion has a dual nature in that a portion of the metal surface is removed, while the formation of insoluble salts contributes to the buildup of deposits. Losses of metal cause deterioration of the structural integrity of the system. Eventually leakage between the water system and process streams can occur.

Corrosion of iron in oxygenated waters is known to occur by the following coupled electrochemical processes:

$$Fe^0 \rightarrow Fe^{+2} + 2e^- \text{ (Anodic Reaction)} \quad (1)$$

$$O_2 + 2e^- \rightarrow 2OH^- \text{ (Cathodic Reaction)} \quad (2)$$

Inhibition of metal corrosion by oxygenated waters typically involves the formation of protective barriers on the metal surface. These barriers prevent oxygen from reaching the metal surface and causing metal oxidation. In order to function as a corrosion inhibitor, a chemical additive must facilitate this process such that an oxygen-impermeable barrier is formed and maintained. This can be done by interaction with either the cathodic or anodic half-cell reaction.

Inhibitors can interact with the anodic reaction 1 by causing the resultant $Fe^{+2}$ to form an impermeable barrier, stifling further corrosion. This can be accomplished by including ingredients in the inhibitor compound which: react directly with $Fe^{+2}$ causing it to precipitate; facilitate the oxidation of $Fe^{+2}$ to $Fe^{+3}$, compounds of which are typically less soluble; or promote the formation of insoluble $Fe^{+3}$ compounds.

The reduction of oxygen at corrosion cathodes provides another means by which inhibitors can act. Reaction 2 represents the half-cell in which oxygen is reduced during the corrosion process. The product of this reaction is the hydroxyl ($OH^-$) ion. Because of hydroxyl production, the pH at the surface of metals undergoing oxygen-mediated corrosion is generally much higher than that of the surrounding medium. Many compounds are less soluble at elevated pH's. These compounds can precipitate at corrosion cathodes and act as effective inhibitors of corrosion if their precipitated form is impervious to oxygen and is electrically nonconductive.

Corrosion inhibitors function by creating an environment in which the corrosion process induces inhibitive reactions on the metal surface. In order for an inhibitor composition to function effectively, the components of the composition must not precipitate under the conditions in the bulk medium. Inhibitors which effectively inhibit this precipitation by kinetic inhibition have been extensively described in the literature. An example of this art is U.S. Pat. No. 3,880,765 which teaches the use of polymers for prevention of calcium carbonate precipitation.

The use of inorganic phosphates and phosphonates in conjunction with a threshold inhibitor in order to control corrosion by oxygenated waters is described by U.S. Pat. No. 4,303,568. This method is further elaborated by U.S. Pat. No. 4,443,340 which teaches that a composition comprised of only inorganic phosphates and a polymeric inhibitor performs well in the presence of dissolved iron.

Corrosion inhibition can be achieved by a combination of the use of inhibitors and modification of the chemistry of the medium. U.S. Pat. No. 4,547,540 teaches a method of corrosion inhibition relying on operation under conditions of high pH and alkalinity. This method does not rely on the use of inorganic phosphates, giving a more desirable product from an environmental impact point of view.

The current invention describes corrosion inhibiting formulations, containing a unique series of polymers, phosphonates and the optional use of aromatic azoles. The use of these polymers results in significantly improved corrosion inhibitor performance.

In general, these compounds are copolymers or terpolymers which have been prepared by post-polymerization derivatization. We have found that these compounds are effective calcium phosphonate inhibitors and that they function effectively as components in a phosphonate containing corrosion inhibitor compound.

INVENTION

The invention includes a method for inhibiting corrosion in industrial cooling waters which contain hardness and have a pH of at least 8, said method comprising dosing said industrial cooling water with a water-soluble organic phosphonate, which term includes blends of phosphonates, capable of providing corrosion inhibition in an aqueous alkaline environment, and an effective amount of a hydrocarbon polymer selected from the class consisting of: N-substituted amide polymer with an amide structure as follows:

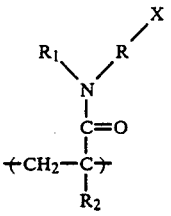

where $R_2$ is hydrogen or methyl, $R_1$ is a hydrogen or a lower alkyl and R is alkylene or phenylene and X is sulfonate, or hydroxy lower alkyl sulfonate and combinations thereof, where the term lower alkyl includes $C_1$, $C_2$, and $C_3$ hydrocarbons.

Preferably, the weight ratio of polymer to phosphonate is within the ranges of from 0.2:1 and 2:1 preferably 0.2:1 to 1:1 and most preferably 0.7:1.

THE DERIVATIZED POLYMERS

The polymers of this invention have been prepared by post-polymerization derivatization. The derivatizing agents of the invention are hydrocarbon groups containing both an amino functionality and at least one of the following groups:

(1) (poly)hydroxy alkyl(aryl);
(2) alkyl and aryl(poly)carboxylic acids and ester analogues;
(3) aminoalkyl(aryl) and quaternized amine analogues:
(4) halogenated alkyl(aryl);
(5) (poly)ether alkyl(aryl);
(6) (di)alkyl;
(7) alkyl phosphonic acid;
(8) alkyl keto carboxylic acid;
(9) hydroxyalkyl sulfonic acid; and
(10) (aryl)alkyl sulfonic acid, wherein the prefix "poly" refers to two or more such functionalities.

The derivatization process of the invention includes direct amidation of polyalkyl carboxylic acids and transamidation of copolymers containing carboxylic acid and (meth)acrylamide units.

Particularly advantageous are polymers of the present invention contain sulfomethylamide-(AMS), sulfoethylamide-(AES), sulfophenylamide-(APS), 2-hdyroxy-3-sulfopropylamide-(HAPS) and 2,3-dihydroxypropylamide units which are produced by transamidation using acrylic acid (AA) or acrylamide (Am) homopolymers and copolymers, including terpolymers, which have a mole percent of acrylamide or homologous units of at least about 10%. The transamidation is achieved using such reactants as aminomethanesulfonic acid, 2-aminoethanesulfonic acid (taurine, 2-AES), 4-aminobenzenesulfonic acid (p-sulfanilic acid), 1-amino-2-hydroxy-3-propanesulfonic acid, or 2,3-dihydroxypropylamine in aqueous or like polar media at temperatures on the order of about 150° C. Once initiated, the reactions go essentially to completion.

Other particularly advantageous polymeric sulfonates of the present invention are produced by an addition reaction between an aminosulfonic acid, such as sulfanilic acid, and taurine, or their sodium salts, and a copolymer of maleic anhydride and a vinylic compound such as styrene, methyl vinyl ether, or (meth)acrylamide.

THE PHOSPHONATES

Generally any water-soluble phosphonate may be used that is capable of providing corrosion inhibition in alkaline systems. See U.S. Pat. No. 4,303,568 which lists a number of representative phosphonates. The disclosure is incorporated herein by reference.

THE ORGANO-PHOSPHONIC ACID DERIVATIVES

The organo-phosphonic acid compounds are those having a carbon to phosphorus bond, i.e.,

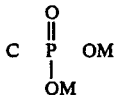

Compounds within the scope of the above description generally are included in one of perhaps 3 categories which are respectively expressed by the following general formulas:

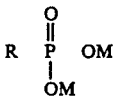

where R is lower alkyl having from about one to six carbon atoms, e.g., methyl, ethyl, butyl, propyl, isopropyl, pentyl, isopentyl and hexyl; substituted lower alkyl of from one to six carbon atoms, e.g., hydroxyl and amino-substituted alkyls; a mononuclear aromatic (aryl) radical, e.g., phenyl, benzene, etc., as a substituted mononuclear aromatic compound, e.g., hydroxyl, amino, lower alkyl subsitituted aromatic, e.g., benzyl phosphonic acid; and M is a water-soluble cation, e.g., sodium, potassium, ammonium, lithium, etc. or hydrogen.

Specific examples of compounds which are encompassed by this formula include:

methylphosphonic acid
$CH_3PO_3H_2$
ethylphosphonic acid
$CH_3CH_2PO_3H_2$ 2-hydroxyethylphosphonic acid
$CH_2—CH_2—PO_3H_2$
|
OH 2-amino-ethylphosphonic acid
$CH_2—CH_2—PO_3H_2$
|
$NH_2$ isopropylphosphonic acid
$CH_3—CH(CH_3)—CH_2—PO_3H_2$ benzene phosphonic acid
$C_6H_5—PO_3H_2$ benzylphosphonic acid
$C_6H_5CH_2PO_3H_2$

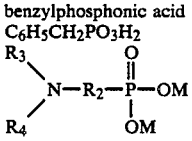

wherein $R_1$ is an alkylene having from about one to about 12 carbon atoms or a substituted alkylene having from about 1 to about 12 carbon atoms, e.g., hydroxyl, amino etc. substituted alkylenes, and M is as earlier defined above.

Specific examplary compounds and their respective formulas which are encompassed by the above formula are as follows:

methylene diphosphonic acid
$H_2O_3P—CH_2—PO_3H_2$
ethylidene diphosphonic acid
$H_2O_3P—CH(CH_3)PO_3H_2$
isopropylidene diphosphonic acid
$(CH_3)_2C(PO_3H_2)_2$ 1-hydroxy, ethylidene diphosphonic acid (HEDP)

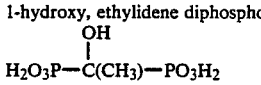

hexamethylene diphosphonic acid
$H_2O_3P—CH_2(CH_2)_4CH_2—PO_3H_2$ trimethylene diphosphonic acid
$H_2O_3P—(CH_2)_3—PO_3H_2$

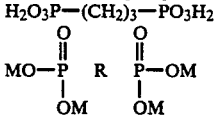

decamethylene diphosphonic acid
$H_2O_3P—(CH_2)_{10}—PO_3H_2$
1-hydroxy, propylidene diphosphonic acid
$H_2O_3PC(OH)CH_2(CH_3)PO_3H_2$ 1,6-hydroxy, 1,6-dimethyl, hexamethylene diphosphonic acid
$H_2O_3PC(CH_3)(OH)(CH_2)_4C(CH_3)(OH)PO_3H_2$
dihydroxy, diethyl ethylene diphosphonic acid
$H_2O_3PC(OH)(C_2H_5)C(OH)(C_2H_5)PO_3H_2$

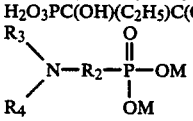

where $R_2$ is a lower alkylene having from about one to about four carbon atoms, or an amine or hydroxy substituted lower alkylene; $R_3$ is $[R_2—PO_3M_2]$ H, OH, amino, substituted amino, an alkyl having from one to six carbon atoms, a substituted alkyl of from one to six carbon atoms (e.g., OH, $NH_2$ substituted) a mononuclear aromatic radical and a substituted mononuclear aromatic radical (e.g., OH, $NH_2$ substituted); $R_4$ is $R_3$ or the group represented by the formula

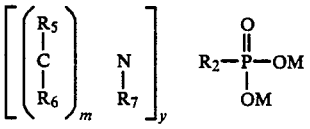

where $R_5$ and $R_6$ are each hydrogen, lower alkyl of from about one to six carbon atoms, a substituted lower alkyl (e.g., OH, $NH_2$ substituted), hydrogen, hydroxyl, amino group, substituted amino group, a mononuclear aromatic radical, and a substituted mononuclear aromatic radical (e.g., OH and amine substituted); R is $R_5$, $R_6$, or the group $R_2—PO_3M_2$ ($R_2$ is as defined above); n is a number of from 1 through about 15; y is a number of from about 1 through about 14; and M is as earlier defined.

Compounds or formulas therefore which can be considered exemplary for the above formulas are as follows:

nitrilo-tri(methylene phosphonic acid)
$N(CH_2PO_3H_2)_3$
imino-di(methylene phosphonic acid)
$NH(CH_2PO_3H_2)_2$
n-butyl-amino-di(methyl phosphonic acid)
$C_4H_9N(CH_2PO_3H_2)_2$
decyl-amino-di(methyl phosphonic acid)
$C_{10}H_{21}N(CH_2PO_3H_2)_2$
trisodium-pentadecyl-amino-di-methyl phosphate
$C_{15}H_{31}N(CH_2PO_3HNa)(CH_2PO_3Na_2)$
n-butyl-amino-di(ethyl phosphonic acid)
$C_4H_9N(CH_2CH_2PO_3H_2)_2$
tetrasodium-n-butyl-amino-di(methyl phosphate)
$C_4H_9N(CH_2PO_3Na_2)_2$
triammonium tetradecyl-amino-di(methyl phosphate)
$C_{14}H_{29}N(CH_2PO_3(NH_4)_2)CH_2PO_3HNH_4$
phenyl-amino-di(methyl phosphonic acid)
$C_6H_5N(CH_2PO_3H_2)_2$
4-hydroxy-phenyl-amino-di(methyl phosphonic acid)
$HOC_6H_4N(CH_2PO_3H_2)_2$
phenyl propyl amino-di(methyl phosphonic acid)
$C_6H_5(CH_2)_3N(CH_2PO_3H_2)_2$
tetrasodium phenyl ethyl amino-di(methyl phosphonic acid)
$C_6H_5(CH_2)_2N(CH_2PO_3Na_2)_2$
ethylene diamine tetra(methyl phosphonic acid)
$(H_2O_3PCH_2)_2N(CH_2)_2N(CH_2PO_3H_2)_2$
trimethylene diamine tetra(methyl phosphonic acid)
$(H_2O_3PCH_2)_2N(CH_2)_3N(CH_2PO_3H_2)_2$
hepta methylene diamine tetra(methyl phosphonic acid)
$(H_2O_3PCH_2)_2N(CH_2)_7N(CH_2PO_3H_2)_2$
decamethylene diamine tetra(methyl phosphonic acid)
$(H_2O_3PCH_2)_2N(CH_2)_{10}N(CH_2PO_3H_2)_2$
tetradecamethylene diamine tetra(methyl phosphonic acid)
$(H_2O_3PCH_2)_2N(CH_2)_{14}N(CH_2PO_3H_2)_2$
ethylene diamine tri(methyl phosphonic acid)
$(H_2O_3PCH_2)_2N(CH_2)_2NHCH_2PO_3H_2$
ethylene diamine di(methyl phosphonic acid)
$H_2O_3PCH_2)_2NH(CH_2)_2NHCH_2PO_3H_2$
n-hexyl amine di(methyl phosphonic acid)
$C_6H_{13}N(CH_2PO_3H_2)_2$
diethylamine triamine penta(methyl phosphonic acid)
$(H_2O_3PCH_2)_2N(CH_2)_2N(CH_2PO_3H_2)$-
$(CH_2)_2N(CH_2PO_3H_2)_2$
ethanol amine di(methyl phosphonic acid)
$HO(CH_2)_2N(CH_2PO_3H_2)_2$
n-hexyl-amino(isopropylidene phosphonic acid)methylphosphonic acid
$C_6H_{13}N(C(CH_3)_2PO_3H_2)(CH_2PO_3H_2)$
trihydroxy methyl, methyl amine di(methyl phosphonic acid
$(HOCH_2)_3CN(CH_2PO_3H_2)_2$
triethylene tetra amine hexa(methyl phosphonic acid)
$(H_2O_3PCH_2)_2N(CH_2)_2N(CH_2PO_3H_2)(CH_2)_2N$-
$(CH_2PO_3H_2)(CH_2)_2N(CH_2PO_3H_2)_2$
monoethanol, diethylene triamine tri(methyl phosphonic acid
$HOCH_2CH_2N(CH_2PO_3H_2)(CH_2)_2NH(CH_2)_2N$-
$(CH_2PO_3H_2)_2$
chloroethylene amine di(methyl phosphonic acid)
$ClCH_2CH_2N((CH_2PO(OH)_2)_2$ The above compounds are included for illustration purposes and are not intended to be a complete listing of the compounds which are operable within the confines of the invention:

Preferred phosphonates are the two compounds:
A. 2-phosphonobutane-1,2 4-tricarboxylic acid and
B. 1-hydroxyethane-1,1-diphosphonic acid.

While individual phosphonates may be used in combination with polymer(s) better results have been obtained by using a blend of phosphonates such as A and B. When they are combined it is in a weight ratio of A:B of from 0.5:1–4:1 and preferable from 0.5:1–2:1 and most preferable about 0.7:1.

In addition to phosphonates, additives such as tolyltriazole may be utilized. Tolyltriazole is effective in the reduction of copper substrate corrosion.

EXAMPLES OF POLYMER PREPARATION

In order to describe the instant species of the derivatized polymers of this invention more fully, the following working examples are given.

Examples 1–3 describe N-substituted amide polymers, while Example 4 describes sulphonated maleic anhydride terpolymer. Molecular weights are weight-averaged values determined by aqueous gel permeation chormatography using polystyrene sulfonic acid standards.

N-SUBSTITUTED AMIDE POLYMER SPECIES

EXAMPLE 1

A mixture of poly(acrylamide [50 mole %]-acrylic acid) (150 g of 31.5% solution in water, Mw 55,700); taurine (16.7 g); and sodium hydroxide (10.6 g 50% solution in water) was heated in a mini Parr pressure reactor at 150° C. for four hours. The reaction mixture was then cooled to room temperature. The molecular weight of the resulting polymer, determined by GPC using polystyrene sulfonate standard, was 56,000. The composition of the polymer was determined both by C-13 NMR and colloid titration and was found to contain about 50% carboxylate, 31% primary amide and 19% sulfoethylamide.

EXAMPLE 2

A mixture of poly(acrylamide [75 mole %]-acrylic acid) (150 g of 27.5% solution in water); sulfanilic acid (20.4 g); sodium hydroxide (9.3 of 50% solution); and 10.5 g of water was heated in a mini Parr pressure reactor at 150° C. for five hours. The reaction mixture was thereafter cooled to room temperature. The weight average molecular weight (Mw) of the resulting polymer was 11,500 as determined by GPC using polystyrene sulfonate standard. The polymer contained about 5% sulfophenylamide, 47.5% primary amide and 47.5% carboxylate as estimated by C-13 NMR.

EXAMPLE 3

A mixture of poly(acrylamide [75 mole %]-acrylic acid) (150 g of 27.5% solution in water); aminomethane sulfonic acid (13.2 g); and sodium hydroxide (10.2 g of 50% solution) was heated in a mini Parr pressure reactor at 125° C. for four-and-a-half hours. The reaction mixture was thereafter cooled to room temperature. The molecular weight of the resulting polymer was 15,900 was determined by GPC using polystyrene sulfonate standard. The polymer contained about 45% acrylic acid, 40% acrylamide and 15% sulfomethylacrylamide as estimated by C-13 NMR.

SYSTEMS TREATED AND pH

The systems treated according to the method of this invention are industrial recirculating and once through cooling waters that either due to their natural make-up or by pH adjustment have a pH of at least 8. Preferabley the pH of the systems are within the range of 8–9.5 and are most often within the range of 8.5–9.2. These systems are characterized as containing at least 10 ppm of calcium ion and are considered to be corrosive to ferrous metals as well as non-ferrous materials with which they come in contact.

DESCRIPTIONS OF A PREFERRED EMBODIMENT

The following is a representative formulation used in this program:

EXAMPLE 4

To a glass or stainless steel container, 14 grams of softened water were added. Then, with stirring, aqueous solutions of the following materials were added consecutively:

7 grams of 1-hydroxyethane-1,1-diphosphonic acid (60 wt%)

12 grams of 2-phosphonobutane-1,2,4-tricarboxylic acid (50 wt %)

23.4 grams of acrylic acid/acrylamide/2-aminoethane sulfonic acid (66/23/11 mol %, $M_w$=48,400, and 32 wt %).

The mixture was cooled in an ice-bath and then basified by slow addition of approximately 22 grams of aqueous sodium hydroxide (50 wt. %) to the vigorously stirred solution. During the addition of base, the solution's temperature was maintained below 130° F. The pH was adjusted to 12.5–13 with 4.5 grams of a 50 weight percent of a sodium tolyltriazole solution. Finally, sufficient softened water to produce 100 grams of product was added. The cooling bath was removed and the solution stirred until ambient temperature was reached.

Changes in the formulation are easily accommodated by simple modification of the previously listed procedure. For example, decreasing the amount of polymer and sodium hydroxide, followed by increasing the final amount of water added, will produce a formulation containing lower polymer actives. Alternatively, the polymer and corrosion inhibitores may be fed separately.

EXPERIMENTAL PROCEDURES

In laboratory tests, hardness cations and M alkalinity are expressed as $CaCO_3$ or cycles of concentration. $Fe^{+2}$ is listed as Fe, and inhibitors (monomeric and polymeric) are listed as actives. In analyses of heat-exchanger deposits, all components are listed as wt% of the chemical element or acid-form of the compound, unless otherwise indicated.

CALCIUM PHOSPOHONATE INHIBITION

A standard heated "beaker" test was employed for evaluating performance of phosphonate inhibitors (Table I). A calcium inhibitor stock solution (10,000 ppm as $CaCO_3$) was prepared using $CaCl_2$—$2H_2O$ and deionized water. In addition, stock solutions (1000 ppm actives) of Bayer PBS-AM, Dequest 2010, and polymeric inhibitors were prepared. Dequest-2010, made by the Monsanto Company, St. Louis, Mo. is described as hydroxy ethylidene-1,1-diphosphonic acid (HEDP) (CF. U.S. Pat. No. 3,959,168). PBS-AM is a trademark of Bayer for 2-phosphonobutane-1,2,4-tricarboxylic acid. To begin the test, distilled water, (400 mL) was added to each jacketed-beaker maintained at 60°±2° C. The stock solutions were added to attain 360 ppm $Ca^{+2}$, 10 ppm inhibitor, 5.6 ppm Dequest and 8 ppm PBS-AM in the final 500 mL test volume. Next, the pH was adjusted to 9.2 using aqueous sodium hydroxide.

The pH of the test samples was manually adjusted at 15 minute intervals during the first hour and at 1 hour intervals, subsequently. A four hour test duration was sufficient for these precipitation reactions to stabilize. Filnally, a portion of each test solution was passed through cellulose acetate/nitrate Millipore filter (type HA, 0.45 um). Both filtered and unfiltered aliquots were spectrophotometrically analyzed for total phosphate content. The % inhibition was determined by using the following formula as indicated below:

$$\% \text{ inhibition} = \frac{[\text{filtered} - \text{blank}]}{[\text{unfiltered} - \text{blank}]} \times 100$$

where, filtered sample=concentration of phosphorus (as $PO_4$) in filtrate in the presence of inhibitor after 4 hours.

initial sample=concentration of phosphorus (as $PO_4$) in test at solution time zero.

blank=concentration of phosphorus (as $PO_4$) in filtrate in absence of inhibitor after 4 hours.

In tests of calcium phosphonate inhibition (Table I), the total phosphorus concentration was used in equation 1.

By definition, an inhibition value of 0% resulted when the polymeric inhibitor was eliminated from the test solution. Due to the severity of the test conditions, inhibition values of 90–100% are indicative of excellent activity in a polymer, whereas 89–80% and 79–60% inhibition indicated superior and very good activity, respectively. Using the above test method, a number of polymer compositions were tested. The calcium phosphonate inhibition results are listed in Table I.

TABLE I

CALCIUM PHOSPHONATE INHIBITION USING DERIVATIZED POLYMERS

| SAMPLE | POLYMER COMPOSITION MOLE % | MOLECULAR WEIGHT, Mw | % PHOSPHONATE SALT INHIBITION P.P.M. POLYMER ACTIVES 15 |
|---|---|---|---|
| $A_1$ | Acrylic acid 79/ Sulfoethyl-acrylamide 21 | 5800 | 100 |
| $A_2$ | Acrylic acid 52/ Acrylamlde 40/ Sulfoethylacryl-amide 7 | 45300 | 100 |
| $A_3$ | Acrylic acid 34/ Acrylamide 54/ Sulfoethylacryl-amide 11 | 43200 | 100 |
| $B_2$ | Acrylic Acid 37/ Acrylamide 23/ Sulfomethylacryl-amide 41 | 81700 | 100 |
| $B_1$ | Acrylic Acid 52/ Acrylamlde 27/ Sulfomethylacryl-amide 21 | 7500 | 100 |
| $B_3$ | Acrylic Acid 23/ Acrylamide 73/ Sulfomethylacryl-amide 4 | 71200 | 100 |
| $B_4$ | Acrylic Acid 13/ Acrylamide 78/ Sulfomethylacryl-amide 9 | 67600 | 99 |
| $C_1$ | Acrylic Acid 40/ Acrylamide 30/ 2-hydroxy-3-sulfo-propyl-acrylamide 30 | 21700 | 95 |
| $C_2$ | Acrylic Acid 80/ Acrylamide 5/ 2-hydroxy-3-sulfo-propyl-acrylamide 15 | 36500 | 93 |
| D | Acrylic Acid 45/ Acrylamide 40/n-propylacrylamide 15 | 11000 | 6 |
| E | Acrylic Acid 45/ Acrylamide 45/Sulfo-phenylacrlamide 10 | 11500 | 2 |

By increasing the availability of phosphorus-based corrosion inhibitors, the polymeric component serves a vital role in providing enhanced corrosion protection when used in conjunction with phosphonates. Stabilization and inhibition of low solubility phosphonate salts is a necessary, although not entirely sufficient, condition for a polymeric material to provide enhanced corrosion protection when used in conjunction with those materials. In order to evaluate which polymers possess superior capability in preventing precipitation of phosphonate salts, benchtop activity tests are initially employed using a standard set of test conditions (15 ppm polymer actives, Table I).

Based on previous testing (e.g. inhibition of calcium and magnesium phosphates), the ability of selected polymers to stabilize and inhibit calcium phosphonate salts is not an obvious property. For example, the polymer Samples A-E in Table I all demonstrate superior to excellent activity (80–90% inhibition at dosage of 10 ppm actives) against phosphate salts. However, only the polymer series A–C exhibit excellent activity against calcium phosphonate salts (93–100% inhibition), while polymer Samples D and E show virtually no activity.

Classes of polymers exhibiting excellent activity against calcium phosphonate salts are also evaluated in more complex systems where calcium, magnesium, phosphonates, and phosphate are present (Table II).

Results obtained for copolymers and terpolymers covering a range of functional groups, compositions, and molecular weights are listed in Table II.

TABLE II

INHIBITION OF CALCIUM AND MAGNESIUM PHOSPHATES IN THE PRESENCE OF PHOSPHONATES

| SAMPLE | POLYMER COMPOSITION MOLE % | MOLECULAR WEIGHT, Mw | % PHOSPHATE SALT INHIBITION P.P.M. POLYMER ACTIVES 15 |
|---|---|---|---|
| $A_1$ | Acrylic acid 79/Sulfoethyl-Acrylamide 21 | 5800 | 89 |
| $A_2$ | Acrylic acid 52/Acrylamide 40/Sulfoethylacrylamide 7 | 45300 | 93 |
| $A_3$ | Acrylic acid 34/Acrylamide 54/Sulfoethylacrylamide 11 | 43200 | 91 |
| $A_4$ | Acrylic Acid 51/Acrylamide 32/Sulfoethylacrylamide 17 | 33000 | 97 |
| $A_5$ | Acrylic acid 95/Sulfoethylacrylamide 5 | 34800 | 94 |
| $A_6$ | Acrylic acid 84/Sulfoethyl-Acrylamide 16 | 31300 | 97 |
| $A_7$ | Acrylic acid 50/Acrylamide 31/Sulfoethylacrylmide 18 | 56000 | 97 |
| $A_8$ | Acrylic acid 23/Acrylamide 19/Sulfoethylacrylamide 58 | 28600 | 93 |
| $A_9$ | Acrylic acid 19/Acrylamide 27/Sulfoethylacrylamide 54 | 44100 | 94 |
| $B_1$ | Acrylic Acid 52/Acrylamide 27/Sulfomethylacrylamide 21 | 7500 | 92 |
| $B_2$ | Acrylic Acid 37/Acrylamide 23/Sulfomethylacrylamide 41 | 81700 | 78 |
| $B_3$ | Acrylic Acid 23/Acrylamide 73/Sulfomethylacrylamide 4 | 71200 | 99 |
| $B_4$ | Acrylic Acid 13/Acrylamide 78/Sulfomethylacrylamide 9 | 67600 | 100 |
| $B_5$ | Acrylic Acid 95/Sulfomethyl-Acrylamide 5 | 18000 | 81 |
| $B_6$ | Acrylic Acid 69/Acrylamide 17/Sulfomethylacrylamide 14 | 19600 | 79 |
| $C_1$ | Acrylic Acid 40/Acrylamide 30/2-Hydroxy-3-sulfopropyl-acrylamide 30 | 21700 | 94 |
| $C_2$ | Acrylic Acid 80/Acrylamide 5/2-Hydroxy-3-sulfopropyl-acrylamide 15 | 36500 | 76 |
| D | Acrylic Acid 45/Acrylamide 40/n-propylacrylamide 15 | 11000 | 12 |
| E | Acrylic Acid 45/Acrylamide 45/Sulfophenylacrylamide 10 | 11500 | 11 |

INHIBITION OF CALCIUM AND MAGNESIUM PHOSPHATES IN MIXTURES CONTAINING PHOSPHONATES

The test procedure is similar to the method previously described for calcium phosphonate inhibition, except for the presence of orthophosphate and differences in hardness levels, pH and temperature. Initially, 250 ppm $Ca^{+2}$ and 125 ppm $Mg^{+2}$ are added together with phosphonates (8 ppm total phosphorus as $PO_4$) and 10 ppm of orthophosphate. Due to the added stress on the system from significant levels of both phosphate and phosphonates, the polymer dosage was 15 ppm actives. The temperature of the stirred test solution is 70° C. (158° F.) and the pH is raised to 8.5 and maintained for 4 hours. The final solution is filtered through a 0.45 um Millipore filter (Type HA). The orthophosphate levels in filtered and unfiltered solutions is determined spectrophotometrically and equation 1 was used to determine % inhibition values.

In industrial water systems, orthophosphate is almost universally present. Orthophosphate may be a component of the make-up water, arise from decomposition of phosphonate corrosion inhibitors or occur from leaching of deposits within the system. When phosphonates and phosphate are both present, the activity of the inhibitor polymer may decrease significantly. Highly active polymers retain their performance towards stabilization of salts of phosphonates, phosphates, and combinations of phosphonates and phosphates. It is not possible to predict which polymers will be effective stabilizers and inhibitors of mixtures of phosphonate and phosphate salts, based on initial activity results against calcium and magnesium phosphonates. More importantly, addition of phosphonates to a system, will degrade the performance of effective polymers towards inhibition of calcium phosphate (e.g. polymer samples D and E), while other inhibitors retain their activity (polymer samples series A–C). Considering the initial activity test results from Tables I and II, the polymer sample series A–C has exhibited a high level of activity under stress conditions which is superior to the polymers currently employed in phosphonate-based programs.

PERFORMANCE IN PRODUCTS—PCT TESTS PILOT COOLING TOWER TEST PROCEDURE

The pilot cooling tower test (i.e. PCT) is a dynamic test which simulates many features present in an industrial recirculating cooling water system. The general test method is described in the article "Small-Scale Short-Term Methods of Evaluating Cooling Water Treatments . . . Are They Worthwhile" by D.T. Reed and R. Nass, Minutes of the 36th Annual Meeting of the INTERNATIONAL WATER CONFERENCE, Pittsburgh, Pa., November 406, 1975.

The general PCT operating conditions are provided in Table III.

The PCT test performance data is provided in Table IV.

TABLE III

| Tube # | Metal*/Heat Load (Btu/ft$^2$-hr) |
|---|---|
| 8 | MS/ 15,000 (top) |
| 7 | SS/15,000 |
| 6 | MS/12,400 |
| 5 | Adm/5,000 |
| 4 | MS/5,000 |
| 3 | SS/12,400 |
| 2 | Adm/12,400 |
| 1 | SS/12,400 (bottom) |
| Average Cycles: ** | 3.7–4 |
| Basin Volume/Temp*** | 50 liter/122–125° F. |
| Holding Time Index | 24 hr. |
| Flow Rate | 2 gpm |
| pH | 9.2 |
| Product - high level | 200 ppm |
| Product - maintenance | 100 ppm |
| Test Duration | 14 days |

MS = Mild Steel
Adm = Admiralty brass
SS = Stainless steel
**Make-up water contains total ion content of 90 ppm $Ca^{+2}$, 50 ppm $Mg^{+2}$, 90 ppm $Cl^-$, 50 ppm sulfate, 110 ppm $Na^+$, and 110–120 ppm "M" alkalinity (as $CaCO_3$).
***Return water is 10° F. higher.

TABLE IV

| Polymer (ppm actives) | Heat Exchange Tube Results: Deposit (mg/day) MS | Adm | SS | Corrosion (mpy) MS | Adm | SS |
|---|---|---|---|---|---|---|
| Blank (0)* | 148 | 8 | — | 8.8 | 0.6 | — |
| $A_5$ (5) | 34 | −3 | 16 | 1.7 | −0.3 | −0.1 |
| $A_4$ (7.5) | 20 | 4 | 14 | 0.4 | 0.1 | 0.1 |
| $C_2$ (7.5) | 26 | 1 | 16 | 1.0 | 0.2 | 0.1 |
| $B_6$ (7.5) | 26 | 2 | 25 | 1.4 | 0.0 | 0.0 |
| AA/Am/t-BAm (7.5) | 21 | 3 | 15 | 1.3 | 0.2 | 0.1 |
| S-SMA (7.5) | 54 | 7 | 27 | 2.8 | 0.3 | 0.1 |

Where AA = acrylic acid
AM = acrylamide
t-BAm = t-butylacrylamide
HPA = hydroxypropylacrylate
S-SMA = maleic anhydride/sulfonated styrene copolymers (Versa TL-4 from National Starch).
*Blank was conducted at return temperature of 110° F. This reduction in the severity of test conditions was necessitated by excessive scaling observed at higher temperatures. Blank formulation was prepared according to the procedure of Example 1without use of polymer.

Each polymer sample was used in combination with a mixture of phosphonates and the high-level feed rate of the phosphonates was equivalent to that obtained from 200 ppm feed of formulations Example 4. Maintenance level feed rate of phosphonates was equivalent to 100 ppm feed of formulation Example 4. Very poor control of corrosion on mild steel and admiralty brass surfaces was observed when no polymeric inhibitor was employed (polymer sample "blank"). By employing polymers of this invention (polymer samples $A_4$, $A_5$, $B_6$ and $C_2$), very good-to-excellent control of mild steel corrosion and good-to-very good control of deposits was obtained which is superior or comparable to that provided by the other currently available polymers. Comparison of cost performance results on the derivatized polymer samples $A_4$, $A_5$, $B_6$ and $C_2$ indicates they are all clearly superior to other available materials. The ability of the derivatized polymers of this invention to function at unusually low dosage under high-temperature stress conditions was demonstrated by acceptable control of mild steel corrosion and deposit from feeding only 5 ppm actives of polymer Sample $A_5$.

TOLYLTRIAZOLE

It has been found advisable in some cases to add small quantities of tolyltrizole.

Tolyltriazole is explained in Hackh's Chemical Dictionary, Fourth Edition, page 91 (CF. benzotriazole) and is employed as a corrosion inhibitor for copper and copper alloy surfaces in contact with water when it is used it is applied to the system at a dosage ranging between 1–20 ppm by weight.

Therefore, we claim:

1. A method for inhibiting corrosion in industrial cooling water which contain hardness and have a pH of at least 8 which comprises dosing the cooling water with from 10–50 ppm of a composition comprising:
   I. A water-soluble organic phosphonate capable of inhibiting corrosion in an aqueous alkaline environment, and
   II. An effective amount of a hydrocarbon polymer selected from the group consisting of: N-substituted amide polymers containing an amide structure as follows:

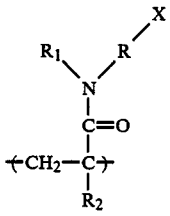

where $R_2$ is hydrogen or methyl, where $R_1$ is a hydrogen or an alkyl and R is alkylene and X is selected from the group consisting of sulfonate, (poly)hydroxyl alkyl with the weight ratio of polymer:phosphonate being within the range of 0.2:1 to 2:1, and where X is sulfonate then R—X— is selected from the group consisting of sulfomethyl, or 2-sulfoethyl.

2. The method of claim 1 wherein x is sulfomethyl.

3. The method of claim 1, wherein the polymer is an acrylic acid/acrylamide/sulfomethylacrylamide having a mole ratio of acrylic acid to acrylamide to sulfomethylacrylamide with the range of 13–95 to 0–73 to 5–41 respectively; and wherein the polymer has a weight average molecular weight within the range of 7,000–82,000.

4. The method of claim 3, wherein the polymer has a mole ratio of acrylic acid to acrylamide to sulfomethylacrylamide within the range of 40–90 to 0–50 to 10–40 respectively; and wherein the polymer has a weight average molecular weight within the range of 10,000–40,000.

5. The method of claim 1, where X is (2-sulfoethyl).

6. The method of claim 1 wherein the polymer is an acrylic/acid/acrylamide/2-sulfoethylacrylamide having a mole ratio of acrylic acid to acrylamide to 2-sulfoethylacrylamide within the range of 19–95 to 0–54 to 5–58 respectively; and wherein the polymer has a weight average molecular weight within the range of 6,000–56,000.

7. The method of claim 6 wherein the polymer has a mole ratio of acrylic acid to acrylamide to 2-sulfoethylacrylamide within the range of 40–90 to 0–50 to 10–40 respectively; and wherein the polymer has a weight average molecular weight within the range of 10,000–40,000.

8. The method of claim 1, wherein the phosphonate dosage includes a ratio of 2-phosphonobutane-1,2,4-tricarboxylic acid to 1-hydroxyethane-1,1-diphosphonic acid within the range of 0.5:1 to 4:1.

9. The method of claim 8 wherein said aqueous system is dosed within the range of 8 to 30 ppm with said composition.

* * * * *